US006898819B2

(12) United States Patent
Tanaka et al.

(10) Patent No.: US 6,898,819 B2
(45) Date of Patent: May 31, 2005

(54) DISPOSABLE TOOTH CLEANING ARTICLE

(75) Inventors: Yuko Tanaka, Kobe (JP); Masato Tanaka, Akashi (JP)

(73) Assignee: The Procter & Gamble Company, Cincinnati, OH (US)

( * ) Notice: Subject to any disclaimer, the term of this patent is extended or adjusted under 35 U.S.C. 154(b) by 55 days.

(21) Appl. No.: 10/459,208

(22) Filed: Jun. 11, 2003

(65) Prior Publication Data

US 2003/0213082 A1 Nov. 20, 2003

Related U.S. Application Data

(63) Continuation of application No. PCT/US00/34390, filed on Dec. 18, 2000.

(51) Int. Cl.[7] ..... A47K 7/02; A47L 13/18
(52) U.S. Cl. ..... 15/227; 15/104.94; 2/21
(58) Field of Search ..... 15/167.1, 227, 15/225, 104.94; 2/21

(56) References Cited

U.S. PATENT DOCUMENTS

| | | | | |
|---|---|---|---|---|
| 1,231,194 A | * | 6/1917 | Prince | 602/58 |
| 2,461,970 A | * | 2/1949 | Finegan | 2/21 |
| 2,921,590 A | * | 1/1960 | Holton | 401/8 |
| 3,902,509 A | | 9/1975 | Tundermann et al. | |
| 4,134,172 A | | 1/1979 | Arce | |
| 4,335,731 A | | 6/1982 | Bora, Jr. | |
| 4,875,247 A | | 10/1989 | Berg | |
| 5,320,531 A | * | 6/1994 | Delizo-Madamba | 433/136 |
| 6,280,529 B1 | | 8/2001 | Meyer | |
| 2003/0168357 A1 | | 9/2003 | Campbell et al. | |

FOREIGN PATENT DOCUMENTS

| | | |
|---|---|---|
| JP | 05-029516 A | 4/1993 |
| JP | 06-000143 A | 1/1994 |

* cited by examiner

*Primary Examiner*—Terrence R. Till
*Assistant Examiner*—Laura C Cole
(74) *Attorney, Agent, or Firm*—Ian S. Robinson; Edward J. Milbrada; Matthew P. Fitzpatrick

(57) ABSTRACT

The disposable tooth cleaning article for manually cleaning tooth surfaces is disclosed. The disposable tooth cleaning article extends in a longitudinal direction and a transverse direction, and has a wearer's finger faced surface and an outer surface. The disposable tooth cleaning article comprises a first sheet and a second sheet. The first sheet and the second sheet form a pouch with an opening. The disposable tooth cleaning article has a distal portion extending opposite to the pouch beyond the opening in the longitudinal direction. The distal portion is wound about the wearer's finger when the disposable tooth cleaning article is used. The finger faced surface is provided with a first attachment means and a second attachment means. The first attachment means is located on the finger faced surface of the distal portion adjacent to one transverse edge of the opening to maintain the wound configuration of the distal portion. The second attachment means is located on the finger faced surface of the disposable tooth cleaning article to contact to the wearer's finger when the distal portion is wound about the finger.

8 Claims, 10 Drawing Sheets

DISPOSABLE TOOTH CLEANING ARTICLE

CROSS REFERENCE TO RELATED APPLICATION

This application is a continuation application of prior copending International Application No. PCT/US00/34390, filed Dec. 18, 2000, designating the U.S.

FIELD OF THE INVENTION

The present invention relates to dental products and particularly to a disposable tooth cleaning article usable after eating and at any convenient time or location during the day for removing food deposits and/or oral cavity juices from the teeth to help reduce plaque build-up. Furthermore, the present invention also relates to an inexpensive disposable tooth cleaning article for babies, children or adults in situations where use of the ordinary tooth brushing equipment is not convenient.

BACKGROUND

Plaque which builds up on the teeth should be removed from the teeth as frequently as possible. Because plaque is responsible for harboring injurious organisms on the teeth, its frequent removal is desirable. In addition, the feel of the teeth to the tongue is very pleasant after removal of plaque from the teeth. It is customary for people to rely upon toothbrushes and tooth paste, dental cream or tooth powder for the day to day cleansing of their teeth and gums. Toothbrushes are effective for this purpose, and in the ordinary home environment they are entirely satisfactory.

On many occasions when a person is away from home, it may be desirable for the person to brush his teeth after ingesting food. For example, a traveler may wish to do so after a meal on an airplane to feel more at ease when talking to fellow travelers, etc., and to maintain good dental hygiene while traveling. A person may prefer to brush his teeth after dinner before continuing on a date or attending a meeting. Parents may desire that their children brush after every meal even when away from home in order for the children to acquire good dental hygiene habits. In each of the foregoing examples, a person could carry his toothbrush with him. However, that is usually inconvenient or many reasons including the fact that a tube of tooth paste would also normally have to be transported with the toothbrush and because return of a wet toothbrush to pocket or purse after use is undesirable. To overcome the toothpaste problems, a tooth brush has been marketed in the form of a pen including a clip for attachment to a pocket and cartridge containing hygiene problem when returned to a pocket in wet condition after use, they are inconvenient for children to carry, and if lost by children, they are relatively costly to replace.

Attempts have been made to provide a portable dental article in various forms. One form of a portable dental article is a sheet-like article. Such a sheet-like article is disclosed in e.g., U.S. Pat. No. 4,335,731. The article is wrapped around the wearer's finger during use of the article. While such a sheet-like article is beneficial in its simple form of a product when manufactured and/or carried, it is problematic that the article may come off from the wearer's finger during use of the article because the article does not have any means to directly attach the article to the wearer's finger.

Another form of a portable dental article is a fingertip-like article. Such a fingertip-like article is disclosed in e.g., U.S. Pat. No. 3,902,509, U.S. Pat. No. 4,134,172 and U.S. Pat. No. 4,875,247. U.S. Pat. No. 3,902,509 discloses a disposable tooth cleaning device made of a high wet strength material which is shaped and sealed in the form of a pocket or flat thimble. The device is formed with two sheets which have been joined in such a manner at three sides as to provide stiff lap edges. U.S. Pat. No. 4,134,172 discloses a toothbrush comprising a bristle-incorporating brushing element which is attached to a flexible sheath into which a person's finger can be inserted to control the brushing action of the brushing element. Such devices are usually produced such that they fit the wearer's finger tight when the device is worn. Therefore, these devices may be too tight if the wearer's finger is quite thick, or the devices may be too loose if the wearer's finger is quite thin. Thus, the devices disclosed in U.S. Pat. No. 3,902,509 and U.S. Pat. No. 4,134,172 are not be adaptable to various sizes of fingers. Furthermore, the devises have no means to attach the device to the wearer's finger. Accordingly, these devices may come off from the wearer's finger during use of the article in the oral cavity if the wearer's finger is thin. This is quite dangerous (especially for infants) because a user may swallow such a device coming off from the wearer's finger during use of the article in the oral cavity.

U.S. Pat. No. 4,875,247 discloses a disposable tooth cleaning product comprising a sheet of thin, flexible material such as paper, cloth or synthetic foam material which may also be formed and contoured. The disposable tooth cleaning product also fits the wearer's finger tight when the device is worn. The disposable tooth cleaning product comprises the finger cover portion and the elongated band having the releasable adhesive surface such that the elongated band is wrapped around the wearer's finger. However, the finger cover portion of the disposable tooth cleaning product has a tight fit shape to the wearer's finger before the elongated band is wrapped around the wearer's finger. This may cause various sizes of fingers tightness or looseness. Thus, the disposable tooth cleaning product disclosed in U.S. Pat. No. 4,875,247 is not adaptable to various sizes of fingers.

JP Utility Model Laid-open publication No. H6-143 discloses a portable dental article comprising a fingertip-like finger cover portion and a grip portion. The finger cover portion has a tight fit shape to the wearer's finger. This may cause various sizes of fingers tightness or looseness. Furthermore, the dental article disclosed in JP H6-143 needs to be held by the wearer's palm with the grip portion during use of the article in order to prevent the article from coming off from the wearer's finger. This may cause the size of the article to get larger and inconvenience operation during use of the article. JP Utility Model Laid-open publication No. H5-29516 discloses a portable dental article comprising a pouch-like finger cover portion and a grip portion. The dental article disclosed in JP H5-29516 needs to be held by the wearer's palm with the grip portion during use of the article in order to prevent the article from coming off from the wearer's finger. This may cause the size of the article to get larger and inconvenience operation during use of the article.

None of the publications above disclose a portable dental article that has adaptability to various size fingers and the article can be fixed to the wearer's finger firmly during use of the article. Thus, none of the existing arts provided all of the advantages and benefits of the present invention.

SUMMARY

The present invention relates to a disposable tooth cleaning article for manually cleaning tooth surfaces. The disposable tooth cleaning article extends in a longitudinal direction and a transverse direction, and has a wearer's finger faced surface and an outer surface. The disposable tooth cleaning article comprises a first sheet and a second sheet. The first sheet and the second sheet form a pouch with an opening. The disposable tooth cleaning article has a distal portion extending opposite to the pouch beyond the opening in the longitudinal direction. The distal portion is wound about the wearer's finger when the disposable tooth cleaning article is used. The finger faced surface is provided with a first attachment means and a second attachment means. The first attachment means is located on the finger faced surface of the distal portion adjacent to one transverse edge of the opening to maintain the wound configuration of the distal portion. The second attachment means is located on the finger faced surface of the disposable tooth cleaning article to contact to the wearer's finger when the distal portion is wound about the finger.

BRIEF DESCRIPTION OF THE DRAWINGS

While the Specification concludes with claims which particularly point out and distinctly claim the invention, it is believed the present invention will be better understood from the following description of preferred embodiments taken in conjunction with the accompanying drawings, in which like reference numerals identify identical elements and wherein:

DETAILED DESCRIPTION

Figure 1:
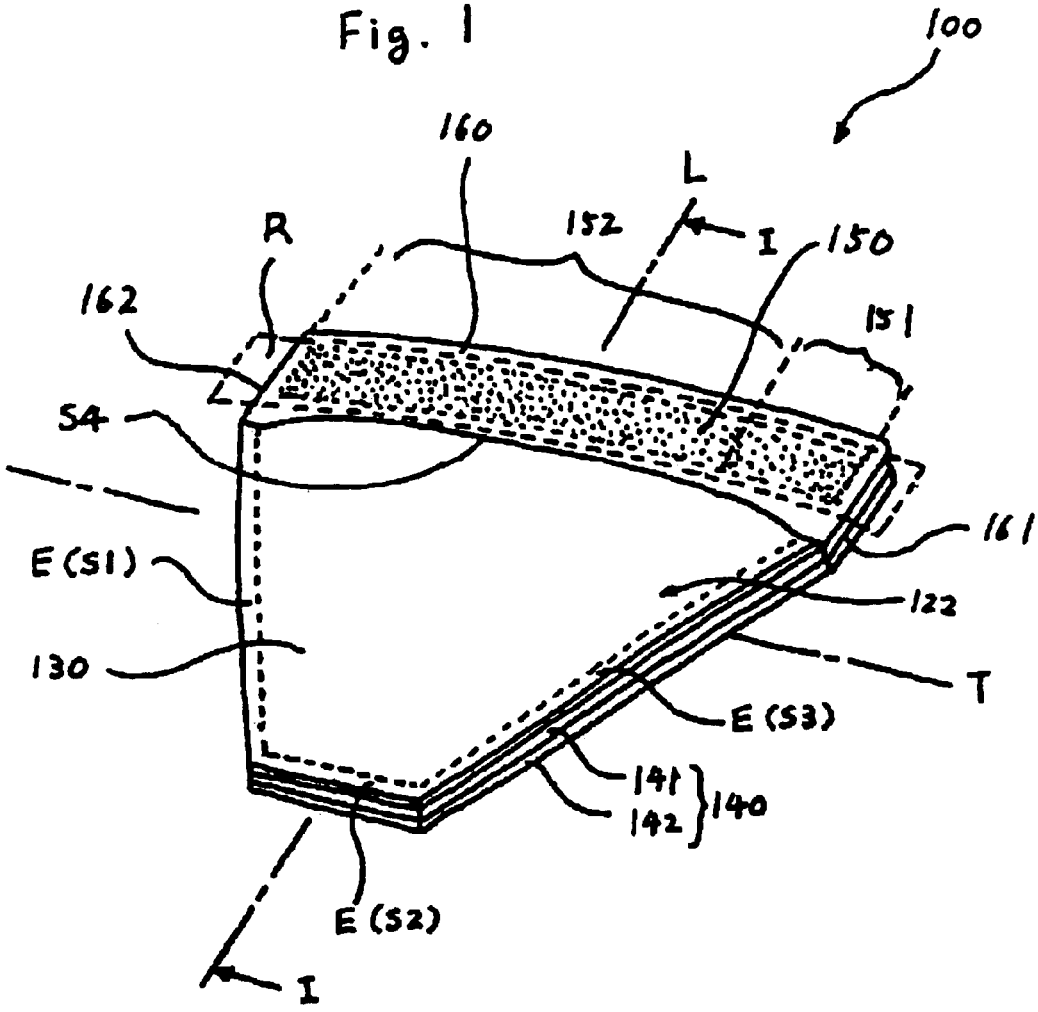
FIG. 1 is a perspective view of one embodiment of a disposable tooth cleaning article.

All cited references are incorporated herein by reference in their entireties. Citation of any reference is not an admission regarding any determination as to its availability as prior art to the claimed invention.

The definitions of several terms are first provided to assist the reader in understanding the present invention.

The term "comprising" means that other steps and other ingredients which do not affect the end result can be added. This term encompasses the term "consisting of" and "consisting essentially of". The term "disposable" as used herein describes devices which generally are not intended to be laundered or otherwise restored or reused (i.e., they are intended to be discarded after a single use and, preferably, to be recycled, composted or otherwise disposed of in an environmentally compatible manner.) The term "longitudinal", as used herein, refers to a line, axis or direction that is generally aligned with the direction in which the finger of the wearer orients in the disposable tooth cleaning article when used. The terms "transverse" or "lateral" used herein, are interchangeable, and refer to a line, axis or direction that is generally perpendicular to the longitudinal direction.

One example of the disposable tooth cleaning article (100) of the present invention is shown FIGS. 1–4. The disposable tooth cleaning article (100) has two centerlines: one is a longitudinal centerline (L) and the other is a transverse (or lateral) centerline (T). The disposable tooth cleaning article (100) has two surfaces: one is a finger faced surface (121) contacting to the wearer's finger when the article (100) is worn, and the other is an outer surface (122) which faces outside when the article (100) is worn. The article (100) comprises a first sheet (130) and a second sheet (140). The first sheet and the second sheet is joined to form a pouch extending in a longitudinal direction and having an opening such that the wearer inserts his/her finger into the pouch in the longitudinal direction. The disposable tooth cleaning article (100) has a distal portion (160) extending opposite to the pouch beyond the opening (170). The distal portion (160) is wound about the wearer's finger when the article (100) is used. The article (100) also comprises an attachment means (150). The attachment means (150) is positioned on the finger faced surface (121) of the distal portion (160). When the attachment means (150) comprises an adhesive, a release sheet (R) may be provided to protect the adhesive from contamination before use of the article (100).

The disposable tooth cleaning article (100) may have any suitable plan view configuration. Suitable configurations include, but are not limited to: triangle shape; circle or oval shape; semicircle shape; sector shape; diamond shape; pentagon shape or the like. In the particularly preferred embodiment shown in FIGS. 1–4, the disposable tooth cleaning article (100) has a substantial trapezoid (or trapezium)-like shape which fits the wearer's fingertip when the article (100) is worn.

The disposable tooth cleaning article (100) may have an overall length such that the article (100) can cover from the fingertip to the finger's first knuckle, preferably to the finger's second knuckle, more preferably to the root of the finger (i.e., to cover the entire wearer's finger) and such that the disposable tooth cleaning article (100) is conveniently sized for carrying on the person so that it is readily at hand whenever cleaning of the teeth is necessary or desirable. The disposable tooth cleaning article (100) may have an overall length of not less than about 20 mm, preferably not less than about 30 mm, more preferably not less than about 40 mm. The disposable tooth cleaning article (100) may also have an overall length of not more than about 100 mm, preferably not more than about 90 mm, more preferably not more than about 80 mm. The disposable tooth cleaning article (100) may have an overall width such that the article (100) can wind around at least half of the circumference of the wearer's finger, preferably the entire of the circumference of the wearer's finger. The disposable tooth cleaning article (100) may have an overall width of not less than about 30 mm, preferably not less than about 40 mm, more preferably not less than about 50 mm. The disposable tooth cleaning article (100) may also have an overall width of not more than about 100 mm, preferably not more than about 90 mm, more preferably not more than about 80 mm.

The article (100) may be formed by joining two sheets; the first and second sheets (130, 140) in this embodiment. The second sheet (140) preferably covers a ventral side of the wearer's finger when the article worn. The first sheet (130) preferably covers a dorsal side of the wearer's finger when the article worn. Alternatively, the article (100) may be formed by a single sheet or by three or more sheets.

The first sheet (130) preferably may cover a dorsal side of the wearer's finger when the article is worn. The first sheet (130) may have any suitable plan view configuration. Suitable configurations include, but are not limited to: triangle shape; circle or oval shape; semicircle shape; sector shape; diamond shape; pentagon shape or the like. In the particularly preferred embodiment shown in FIGS. 1–4, the first sheet (130) has a substantial trapezoid (or trapezium) shape which fits the wearer's fingertip when the article (100) is worn.

The first sheet (130) is preferably compliant, soft feeling, and non-irritating to the oral cavity. A suitable first sheet (130) may be manufactured from a wide range of materials such as woven and nonwoven materials; polymeric materials such as thermoplastic films, plastic films, and hydroformed thermoplastic films; foams; reticulated foams; reticulated thermoplastic films; and thermoplastic scrims. The first sheet (130) is preferably made of a liquid impermeable material to isolate the wearer's skin from oral cavity juices/sputum during use of the article (100). In the embodiment shown in FIGS. 1–4, the first sheet 130 comprises a single sheet formed by a nonwoven. Preferably the nonwoven is made of liquid impermeable thermoplastic fibers to isolate the wearer's skin from oral cavity juices/sputum during use of the article (100). Any plastic film, coating, or wax may be used, as long as it gives liquid impermeability to at least the finger faced surface (121) of the first sheet (130).

In the embodiment shown in FIGS. 1–4, the first sheet (130) comprises a single sheet. The material of the first sheet (130) may be formed with any materials so that the first sheet (130) is liquid impermeable. In particular, the material of the first sheet (130) may comprise any material such as a nonwoven or a polymeric film. The first sheet (130) may be formed by a plurality of layers, i.e., two or more layers. In one embodiment, the first sheet (130) may comprise two layers comprising an outer sheet and an inner sheet. The outer sheet of the first sheet (130) typically at least partially may come in contact with oral cavity juices/sputum during use of the article (100). The inner sheet of the first sheet (130) typically at least partially comes in contact with the wearer's finger during use of the article (100). The material of the inner/outer sheets of the first sheet (130) may be formed with any material so that the first sheet (130) is liquid impermeable. In particular, the inner/outer sheets may comprise any material such as a nonwoven or a polymeric film. Preferably the outer sheet comprises a nonwoven and the inner sheet comprises a film. The outer sheet comprising a nonwoven presents an uneven surface to the oral cavity and thus greatly improves the membrane healthiness in the oral cavity. The first sheet (130) may be formed from a laminate comprising a nonwoven layer and a polymeric film. Alternatively, the first sheet (130) may comprise three layers; one film layer and two nonwoven layers. The film may be interposed between the two nonwoven layers. This sequence of layers results in a closed fibrous structure, which has a particularly pleasing sensation on contact with the skin of the wearer.

Suitable woven and nonwoven materials for the outer sheet can be comprised of natural fibers (e.g., wood or cotton fibers), synthetic fibers (e.g., polymeric fibers such as polyester, polypropylene, polyamide, polyolefin or polyethylene fibers) or from a combination of natural and/or synthetic fibers. The fibers may have any shape such as a circular cross section shape or a non-circular cross section shape, preferably a non-circular cross section shape. The fiber denier can be any of range depending up on the end use. Polyolefin polymer based nonwoven is beneficial in several reasons such as cost, processability into a form of fibers, or softness in the form of fibers.

The nonwoven web can be made by any known methods. It may be made by bonding of web-like arrays of fibers or filaments. The web may be made from fibers of discrete length ranging from few millimeter to few meters by carding or wet or air laying process or they may be produced by laying or blowing filaments as they are being melt extruded. The fabrics made by these latter process are commonly known as spunbonded or spunlaid and melt-blown nonwoven webs. A spunbonded nonwoven web may be defined generically as continuous filament fibrous structures which are made in the form of fabrics, sheets or tapes and are prepared from synthetic polymers in a process integrated with fiber manufacture. A melt-blown nonwoven web is a fibrous structure produced by extruding a polymer melt through a die into a high velocity stream of hot air to produce fine or super fine fibers which are deposited on a moving screen after quenching. A carded nonwoven web are made from webs of carded fibers. The preferred polymer for the production of filaments or fibers for making the nonwoven web is polyolefins such as polyethylene or polypropylene. In one embodiment, a preferred nonwoven web for the use of the outermost sheet of the disposable tooth cleaning article of the present invention may be a spunbond-meltblown-spunbond nonwoven comprising polypropylene fibers with a basis weight of between about 10 $g/m^2$ and about 30 $g/m^2$. An exemplary nonwoven web for the use of the present invention is supplied by Mitsui Chemical in Japan under the designation code of PQ1151 (commercial name: Syntex 15 gsm).

Suitable film materials for the inner sheet may comprise a thermoplastic material. The thermoplastic material can be selected from among all types of polyolefins especially polyethylene, polypropylene, amorphous polyolefins, and the like; material containing meltable components comprising fibers or polymeric binders including natural fibers such as cellulose wood pulp, cotton, jute, hemp; synthetic fibers such as fiberglass, rayon, polyester, polyolefin, acrylic, polyamid, aramid, polytetrafluroethylene metal, polyamide; binders such as bicomponent high melt/low melt polymer, copolymer polyester, polyvinyl chloride, polyvinyl acetate/chloride copolymer, copolymer polyamide, materials comprising blends wherein some of the constituent materials are not meltable; air and vapour permeable materials including microporous films such as those supplied by EXXON Chemical Co., III, US under the designation EXXAIRE or those supplied by Mitsui Chemical Co., Japan under the designation ESPOIR NO; and monolithic breathable materials such as Hytrel™ available from DuPont and Pebax™ available from ELF Atochem, France. In a preferred embodiment, a film which is comprised in any layer is preferably permeable to gases such as air and to vapour such as water vapour in order to avoid the problem of entrapment and condensation of moisture vapour given off by the body of the wearer and thus, the hot, clammy and uncomfortable conditions after a short period of use.

The second sheet (140) preferably may cover with a ventral side of the wearer's fingernnn when the article worn. The second sheet (140) may have any suitable plan view configuration. Suitable configurations include, but are not limited to: triangle shape; circle or oval shape; semicircle shape; sector shape; diamond shape; pentagon shape on the like. In the particularly preferred embodiment shown in FIGS. 1–4, the second sheet (140) has a substantial trapezoid-like shape which fits the wearer's fingertip when the article (100) is worn.

The second sheet (140) is preferably compliant, soft feeling, and non-irritating to the oral cavity. A suitable second sheet (140) may be manufactured from a wide range of materials such as woven and nonwoven materials; polymeric materials such as thermoplastic films, plastic films, and hydroformed thermoplastic films; foams; reticulated foams; reticulated thermoplastic films; and thermoplastic scrims. Suitable woven and nonwoven materials can be comprised of natural fibers (e.g., wood or cotton fibers), synthetic fibers (e.g., polymeric fibers such as polyester, polypropylene, polyamide, polyolefin or polyethylene fibers) or from a combination of natural and synthetic fibers. The second sheet (140) is preferably made of a liquid impermeable material to isolate the wearer's skin from oral cavity juices/sputum. Any plastic film, coating, or wax may be used, as long as it gives liquid impermeability to at least the finger faced surface (121) of the second sheet (140).

The second sheet (140) may also be fabricated from any material that has relatively high wet strength and will not disintegrate from abrasive contact with the teeth which occurs during use of the article (100). Standard commercial high wet strength paper is satisfactory, as well as woven and nonwoven fabrics. Additionally, high wet strength water proof thermoplastics such as polyethylene may be used. The outer surface (122) of the second sheet (140) may be embossed or provided with any other suitable texture to provide additional abrasive action to aid in plaque removal.

The second sheet (140) may comprise a single sheet. The material of the second sheet (140) may be formed with any materials so that the second sheet (140) is liquid impermeable. In particular, the material of the second sheet (140) may comprise any material such as a nonwoven or a polymeric film. The second sheet (140) may also be formed by a plurality of layers, preferably two or more layers. In the embodiment shown in FIGS. 1–4, the second sheet (130) comprises two layers comprising an inner sheet (141) and an outer sheet (142). The outer sheet (142) of the second sheet (140) typically at least partially may come in contact with oral cavity juices/sputum during use of the article (100). The inner sheet (141) of the second sheet (140) typically at least partially comes in contact with the wearer's finger during use of the article (100). The material of the inner/outer sheets (141, 142) of the second sheet (140) may be formed with any material so that the second sheet (140) is liquid impermeable, more preferably, the outer sheet (142) may comprise any material so that the outer sheet (142) has suitable roughness/friction to remove food deposits and suitable absorbency to absorb oral cavity juices. In particular, the inner/outer sheets (141, 142) may comprise any material such as a nonwoven or a polymeric film. Preferably the outer sheet (142) comprises a nonwoven and the inner sheet (141) comprises a film. The outer sheet (142) comprising a nonwoven presents an uneven surface to the oral cavity and thus greatly improves the membrane healthiness in the oral cavity. In the embodiment shown in FIGS. 1–4, the inner sheet (141) comprises a liquid impermeable film, and the outer sheet (142) comprises a nonwoven comprising natural fibers, such cotton fibers. The outer surface (122) of the outer sheet (142) may form reticulate, fluff-like, loop-like and/or hook-like fibers on its surface to remove food deposits and/or oral cavity juices efficiently from the teeth. This enables the article (100) to isolate the wearer's finger from oral cavity juices/sputum because the inner sheet (141) is liquid impermeable, furthermore, to improve the membrane healthiness in the oral cavity greatly because the outer sheet (142) comprises a nonwoven comprising natural fibers, such cotton fibers. In addition, the second sheet (140) may comprise a brushing element comprising bristles on the outer surface (122) of the outer sheet (142) to remove food deposits and/or oral cavity juices efficiently from the teeth. The second sheet (140) may be formed from a laminate comprising a nonwoven layer and a polymeric film. Alternatively, the second sheet (140) may comprise three layers; one film layer and two nonwoven layers. The film may be interposed between the two nonwoven layers. This sequence of layers results in a closed fibrous structure, which has a particularly pleasing sensation on contact with the skin of the wearer.

The first/second sheets (130, 140) to form the article (100) may be bonded together by any means known in the art, such as a heat seal. In addition, a hot melt adhesive, or any medically approved water resistant adhesive such as a double-side tape (3M1524), may be provided on the finger faced surface (121) of the article (100) for heat seal. The first sheet (130) and the second sheet (140) are preferably joined at the periphery edge (E) of the article (100) by a heat seal. The first sheet (130) has a substantial trapezoid shape, therefore, has four sides (S1)–(S4) as shown in FIG. 1. The periphery edge (E) of the article (100) sealed to join the first sheet (130) and the second sheet (140) corresponds to three sides (S1)–(S3) of the first sheet (130). In the embodiment shown in FIGS. 1–4, the inner sheet (141) comprising thermoplastic fibers and the second sheet (142) comprising cotton fibers are also joined one another by a heat seal. In this case, the inner/outer sheets (141, 142) can be joined one another because of the intrusion of the melted synthetic fibers into the space between cotton fibers.

A seal strength between the first sheet (130) and the second sheet (140) is important to prevent the first and second sheet (130, 140) from peeling off one another. The seal strength for the first and second sheets (130, 140) is measured by a tensile tester. The tensile tester is a device constructed in such a way that a gradually increasing load is smoothly applied to a defined sample portion until the sample portion breaks. The tensile at the point of breakage (at which time the sample breaks) is frequently called "peak" tensile, or just "peak". The suitable instrument used for the measurement is Instron 5564 which may be equipped with either digital readout or strip chart data display for load and elongation. The following procedure is conducted under standard laboratory conditions at 23° C. (73° F.) and 50% relative humidity for a minimum of 2.0 hours.

(1) Cut a sample into a strip having 1 inch by 5 inches size. At least three strips should be prepared for the measurement.

(2) Put the sample strip in the instrument. The way to set the sample strip is to insert the sample strip into the top clamp of the instrument first, and then to clamp the sample strip into the bottom clamp with enough tension to eliminate any slack of the sample strip.

(3) Strain the sample strip at 5 inches/minute until breaking it.

(4) Read the peak tensile value.

(5) Repeat the above procedures (1) to (4) for the other sample strips.

(6) Calculate the average tensile as follows:

$$\text{Average Tensile (g/in)} = \frac{\text{Sum of the peak loads for samples tested}}{\text{number of test strips tested}}$$

The average tensile value for use herein is the average tensile of the three samples. Calculate and report to the nearest whole unit. The seal strength may be at least 120 g/in, preferably 300 g/in, and more preferably 500 g/in to prevent tearing during use.

Figure 6A:
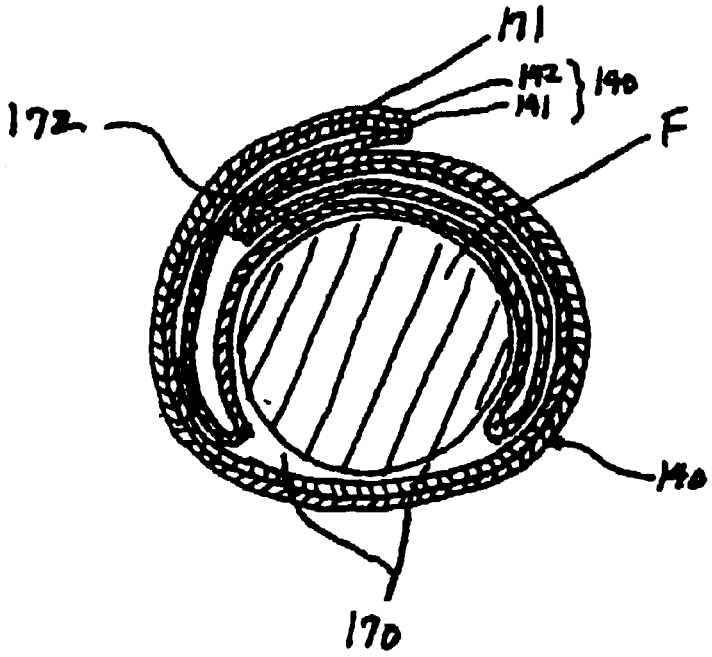
FIG. 6A is a cross-sectional view taken along line 11—11 of FIG. 5C.

The opening (170) for insertion of the wearer's finger is formed at the position of the side (S4). Only the side (S4) of the first sheet (130) shown in FIG. 1 is not sealed, whereby, the first sheet (130) and the second sheet (140) can form a pouch with the opening (170). In the embodiment shown in FIGS. 1–4, the side (S4) of the first sheet (130) is straight along the transverse direction. The opening (170) may have a width which is identical with the overall width of the article (100). The opening (170) preferably has a width such that both edges (171, 172) of the opening (170) overlap to one another when the distal portion (160) is wound about the wearer's finger to wear the article (100) as shown in FIG. 6A. Such a size of the opening (170) of the disposable tooth cleaning article (100) enable the article (100) to be acceptable to various size of fingers.

The opening (170) may have an overall width such that the opening (170) can wind around at least half of the circumference of the wearer's finger, preferably the entire of the circumference of the wearer's finger. The opening (170) may have a width of not less than to about 20 mm, preferably not less than about 30 mm, more preferably not less than about 40 mm. The opening (170) may also have a width of not more than about 100 mm, preferably not more than about 90 mm, more preferably not more than about 80 mm.

Figure 10:
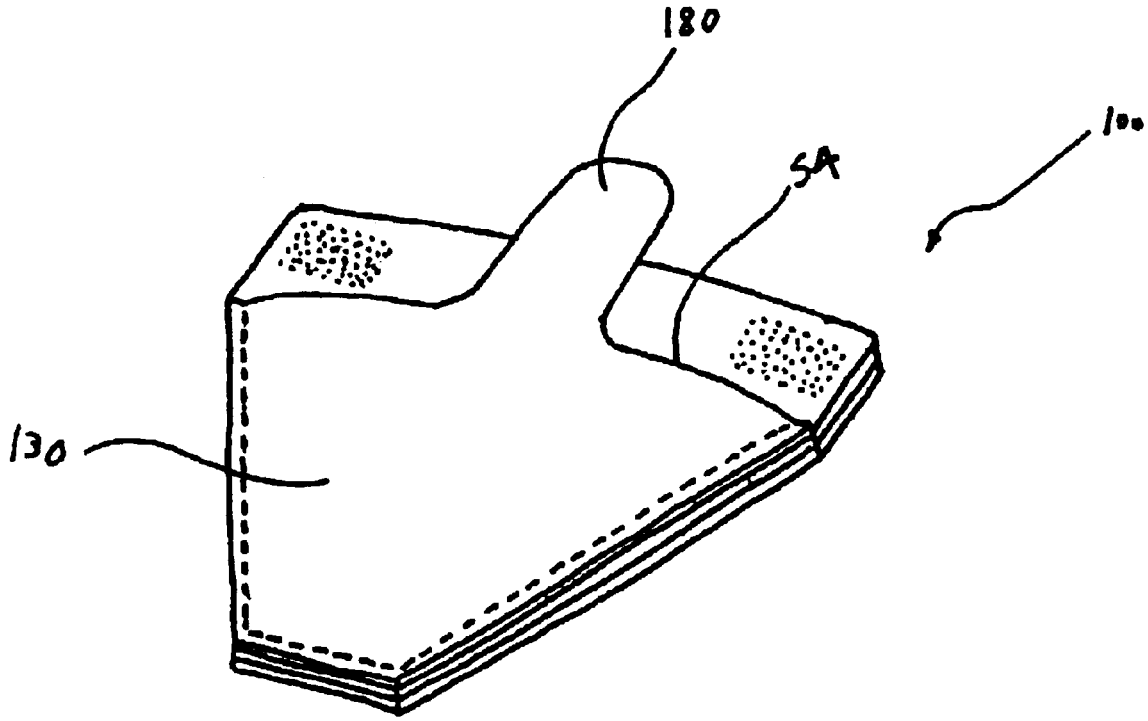
FIG. 10 is a perspective view of another embodiment of the disposable tooth cleaning article.
Figure 11:
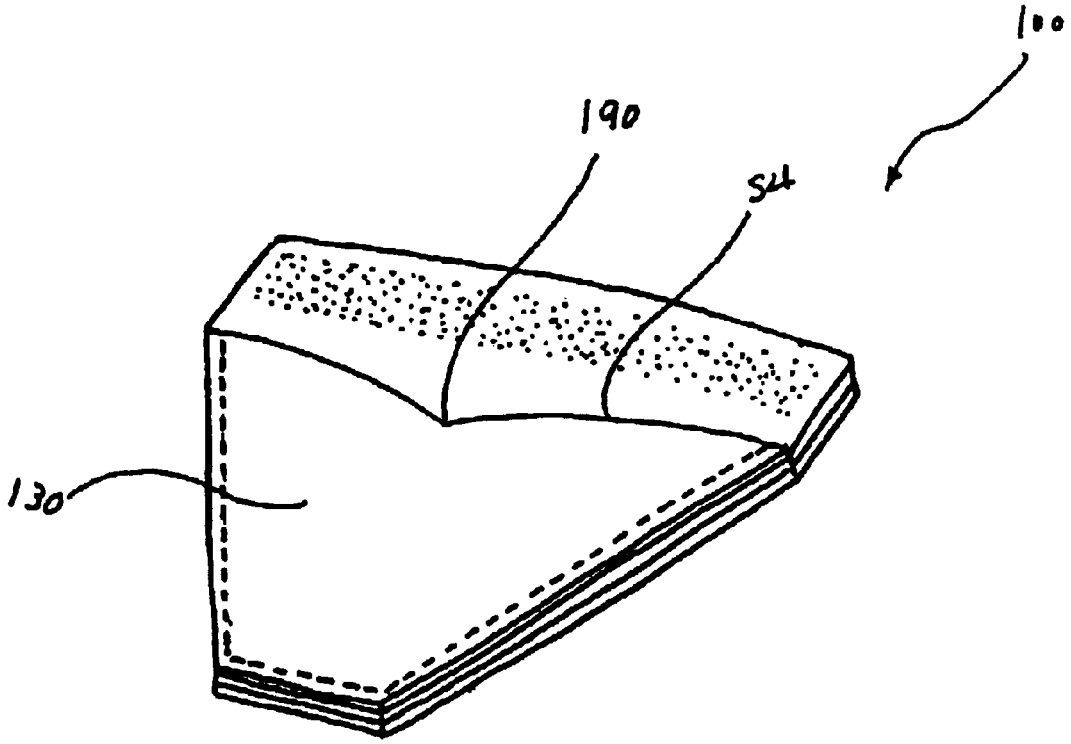
FIG. 11 is a perspective view of another embodiment of the disposable tooth cleaning article.

Alternatively, the side (S4) of the first sheet (130) may have an extra cover portion (180) extending in longitudinal direction as shown in FIG. 10 to fit the first sheet (130) to the wearer's finger firmly when the distal portion (160) is wound about the wearer's finger. Alternatively the side (S4) of the first sheet (130) may have a notch portion (190) at the center of the side (S4) as shown in FIG. 11 to insert the wearer's finger into the opening (170) smoothly.

Figure 2:
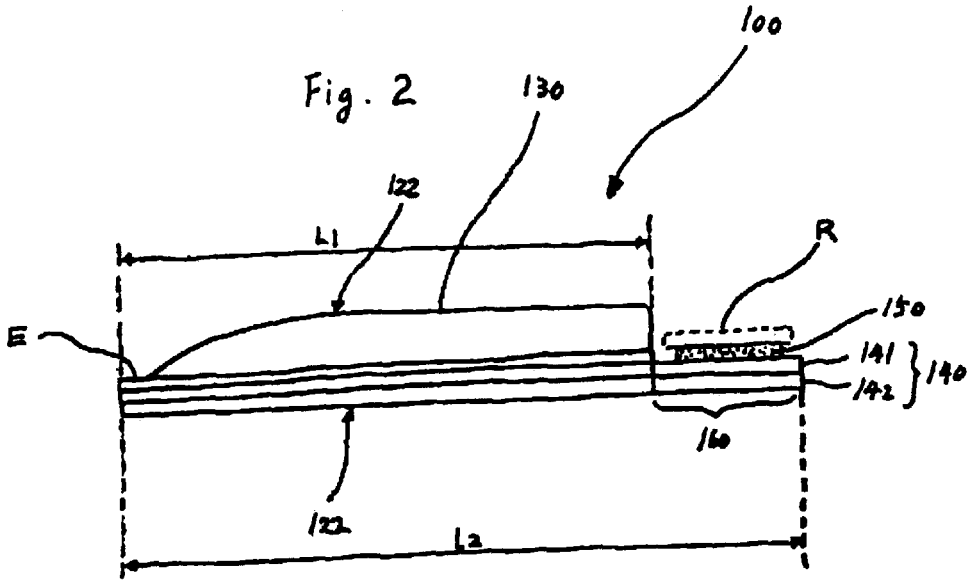
FIG. 2 is a side view of the disposable tooth cleaning article of FIG. 1.
Figure 3:
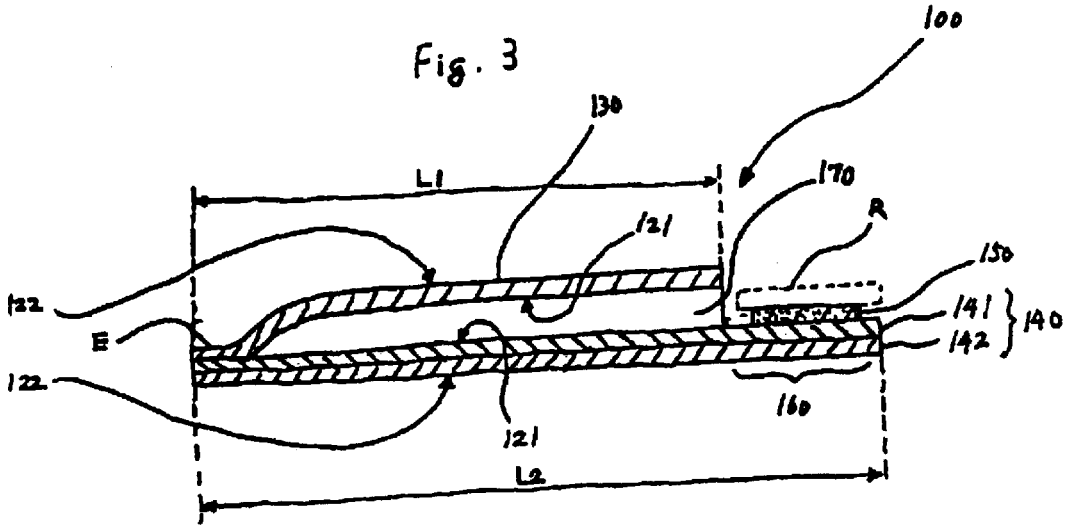
FIG. 3 is a cross-sectional view taken along line I—I of FIG. 1.

The distal portion (160) is formed in order to be wound around the wearer's finger when the article (100) is worn. The distal portion (160) is formed with the extension of the second sheet (140) of the article (100). The length (L1) shown along the longitudinal centerline (L) of the first sheet (140) is shorter than the length (L2) of the second sheet (140) as shown in FIGS. 2 and 3. The distal portion (160) has a width being equal to or longer than the width of the opening (170). In addition, both edges (161, 162) of the distal portion (160) preferably overlap to one another when the distal portion (160) is wound about the wearer's finger to wear the article (100).

The distal portion (160) may have an overall width such that the distal portion (160) can wind around at least half of the circumference of the wearer's finger, preferably the entire of the circumference of the wearer's finger. The distal portion (160) may have a width of not less than to about 30 mm, preferably not less than about 40 mm, more preferably not less than about 50 mm. The distal portion (160) may also have a width of not more than about 100 mm, preferably not more than about 90 mm, more preferably not more than about 80 mm.

The distal portion (160) may have a length (i.e., L2–L1 shown in FIGS. 2 and 3) in longitudinal direction such that a sufficient volume of the attachment means (150) to attach the article (100) to the wearer's finger is applied to the finger faced surface (121) of the distal portion (160). The distal portion (160) may have a length of not less than to about 1 mm, preferably not less than about 5 mm, more preferably not less than about 10 mm. The distal portion (160) may also have a length of not more than about 30 mm, preferably not more than about 25 mm, more preferably not more than about 20 mm.

Figure 4:
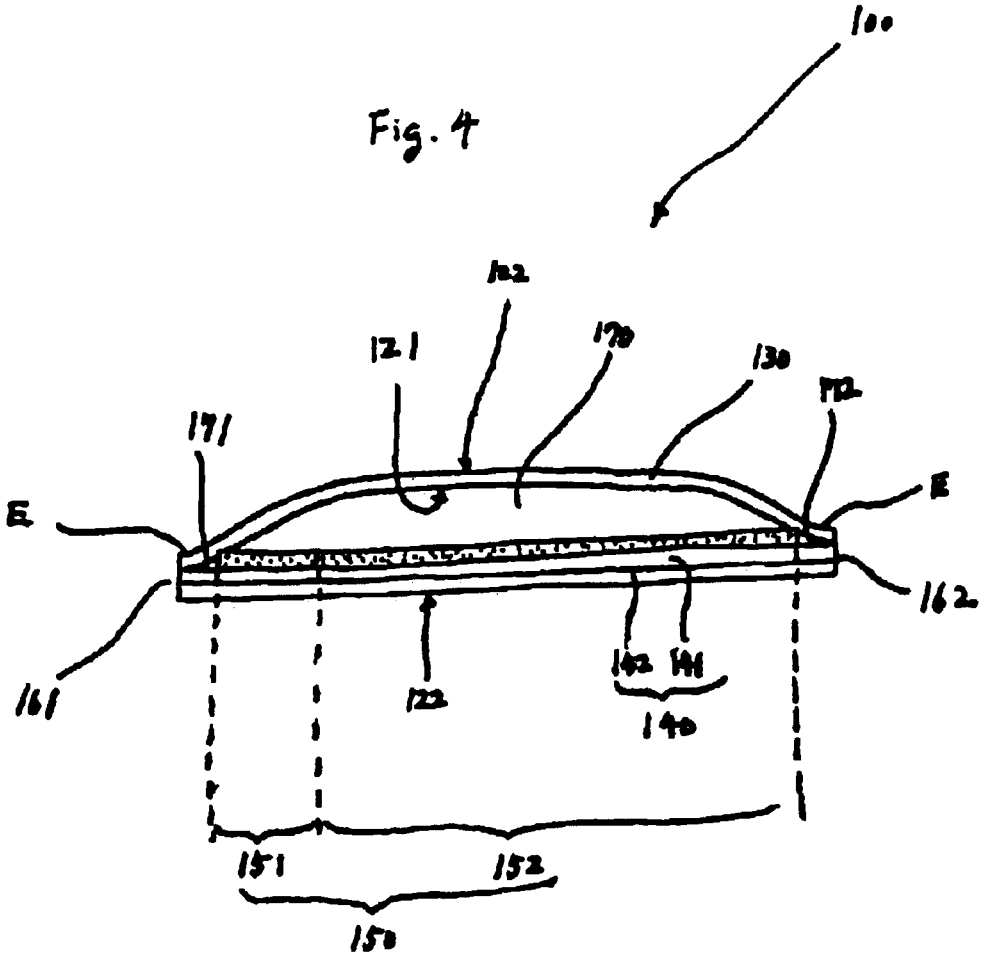
FIG. 4 is a back view of the disposable tooth cleaning article of FIG. 1.
Figure 6B:
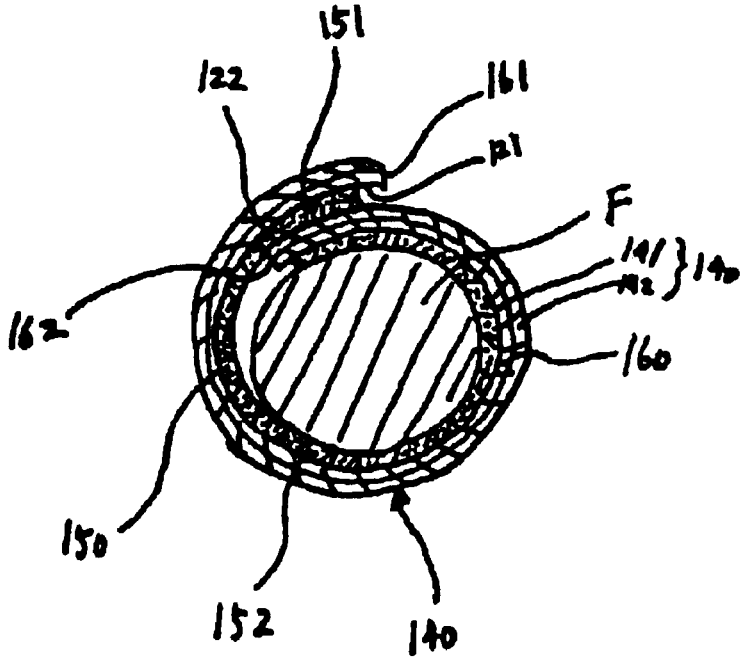
FIG. 6B is a cross-sectional view taken along line III—III of FIG. 5C.
Figure 7:
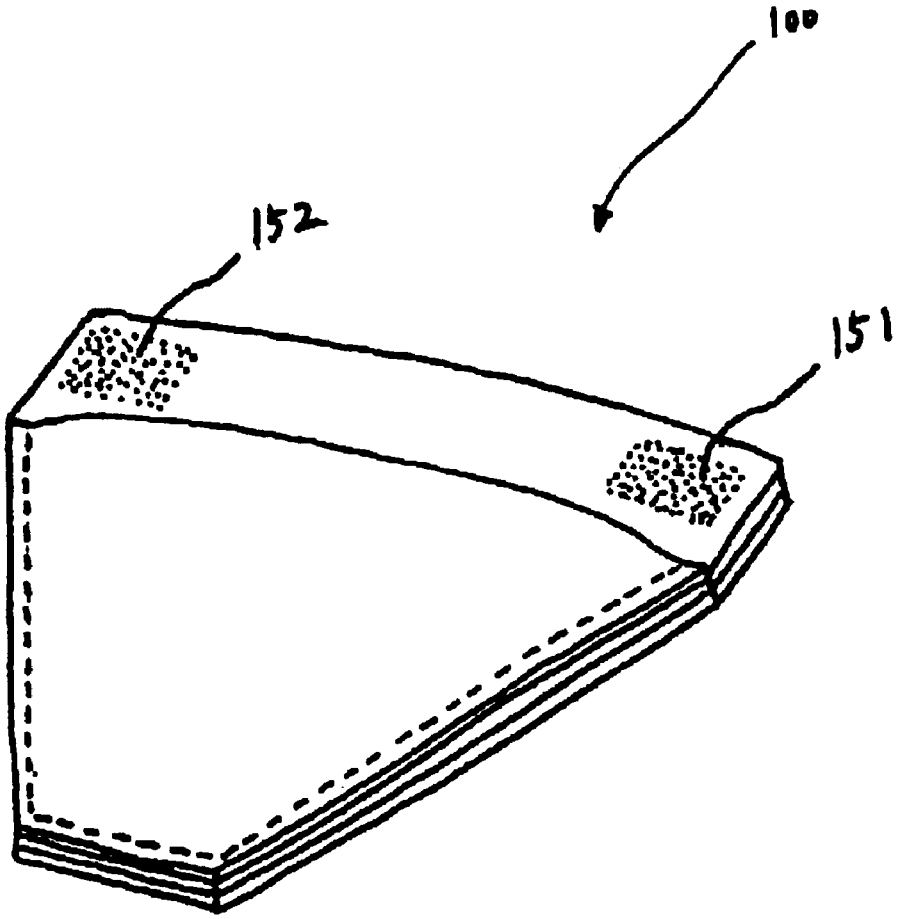
FIG. 7 is a perspective view of another embodiment of the disposable tooth cleaning article.
Figure 8:
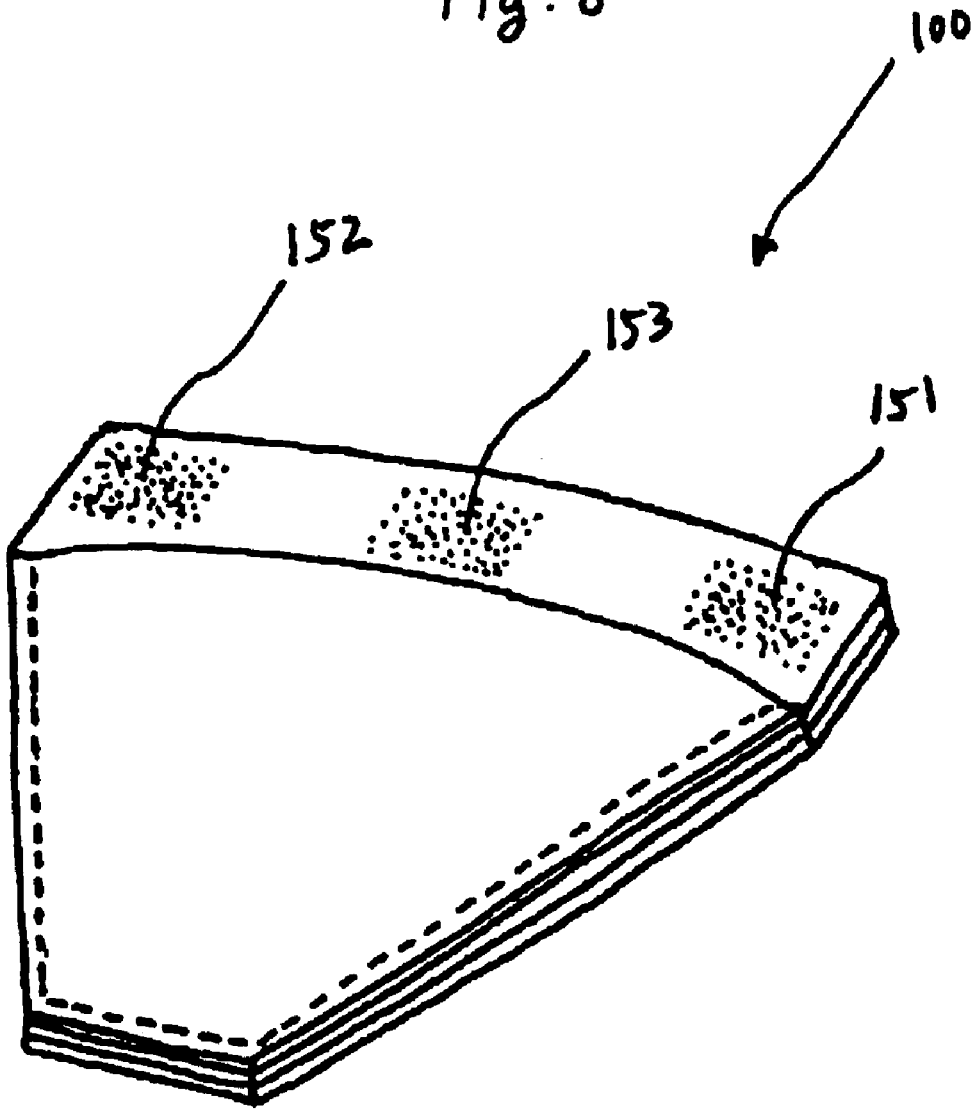
FIG. 8 is a perspective view of another embodiment of the disposable tooth cleaning article.
Figure 9:
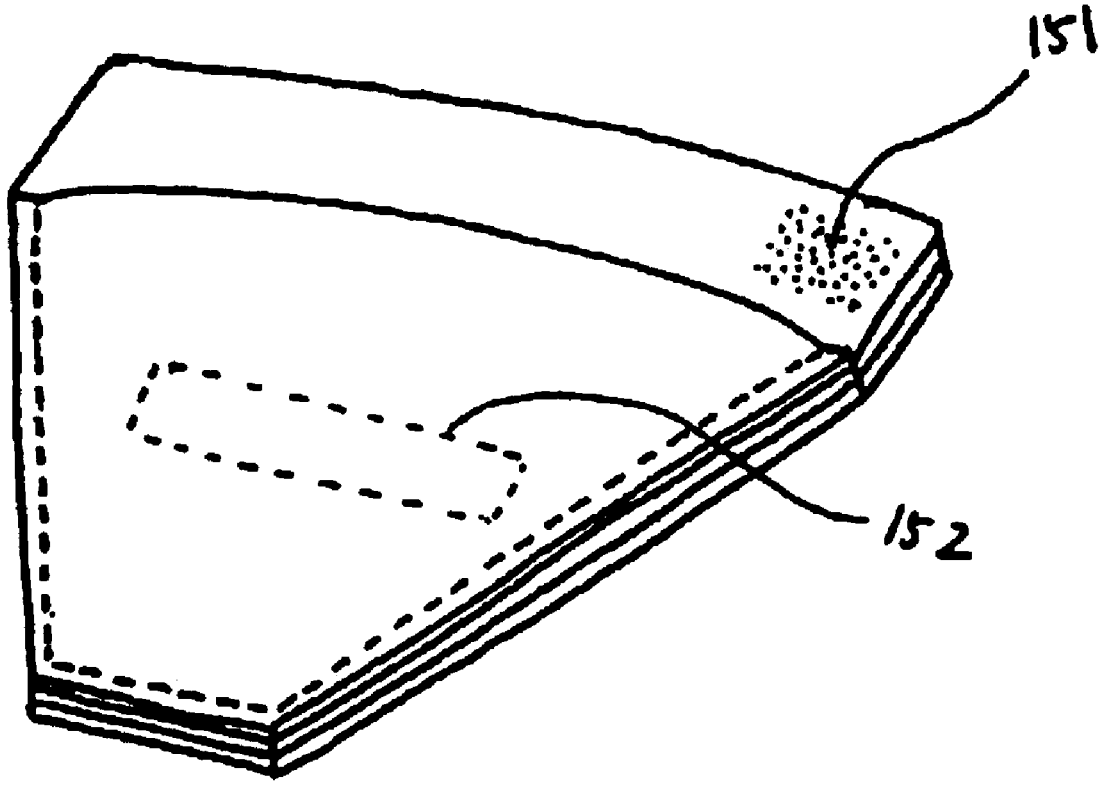
FIG. 9 is a perspective view of another embodiment of the disposable tooth cleaning article.

The attachment means (150) extending in the transverse direction is provided on the finger faced surface (121) of the distal portion (160) such that the article (100) is secured around the wearer's finger by the attachment means (150) when the article (100) is worn. The attachment means (150) preferably has at least two portions, a first attachment means (151) and a second attachment means (152) as shown in FIGS. 1 and 4. The first attachment means (151) should be located adjacent to one of the transverse edges (171 or 172) of the opening (170) to maintain the wound configuration of the distal portion (160) when the article (100) is worn. The first attachment means (151) is located adjacent to one transverse edge (161 or 162) of the distal portion (160) on of the finger faced surface (121) of the distal portion (160). In the embodiment shown in FIGS. 1–4, the first attachment means (151) is located adjacent to the edge (171) of the opening (170) and the edge (161) of the distal portion (160). The second attachment means (152) is located on the finger faced surface of the article (100) to contact to the wearer's finger directly when the distal portion (160) is wound about the wearer's finger. The second attachment means (152) may be located anywhere on the finger faced surface (121) of the article (100) as long as the second attachment means (152) contacts to the wearer's finger directly. In the embodiment shown in FIGS. 1–4, the second attachment means (152) is located on the finger faced surface (121) of the distal portion (160) and adjacent to the first attachment means (151). When the article (100) winds around a half of the circumference of the wearer's finger, both the first attachment means (151) and the second attachment means (152) contact to the wearer's finger directly to maintain the wound configuration of the distal portion (160) and to attach the article (100) to the wear's finger directly. In the case, it is desirable that the first attachment means (151) is located adjacent to one of the transverse edges of the distal portion (160) and the second attachment means (152) is located adjacent to the other of the transverse edges of the distal portion (160). When the article (100) winds the entire of the circumference of the wearer's finger, the first attachment means (151) contacts to the outer surface (122) of the distal portion (160) to maintain the wound configuration of the distal portion (160) because the edge (161) and the edge (162) overlap one another as shown in FIG. 6B. Further, the second attachment means (152) contacts to the wearer's finger directly to attach the article (100) to the wearer's finger firmly. In the case, it is desirable that the first attachment means (151) is located adjacent to one of the transverse edges of the distal portion (160) to maintain the wound configuration of the distal portion (160) firmly. The existence of the first and second attachment means (151, 152) ensure the article (100) sufficient attachment to the wearer's finger (F) during use of the article (100). In the embodiment, the first attachment means (151) and the second attachment means (152) are formed continuously as one unit in the embodiment shown in FIGS. 1–6B. Alternatively they may be separated from each other as shown in FIG. 7 Furthermore, the attachment means (150) may be divided into three parts; the first attachment means (151), the second attachment means (152) and the third adhesive (153) as shown in FIG. 8. In addition, the second attachment means (152) may be located on the finger faced surface (121) of the first sheet (130) as shown in FIG. 9.

Any medically approved water resistant pressure sensitive adhesive may be used for the attachment means (150) to attach the article (100) to the wearer's finger, such as hydrocolloid adhesives, hydrogel adhesives, lipogel adhesive and/or double-side tape. Particularly effective adhesives in providing the desired adhesive properties to secure the article (100) to the wearer's finger when the article (100) is worn, whilst allowing for relatively painless application and removal are hydrophilic hydrogels formed from crosslinking polymers with a plasticiser to form a three-dimensional matrix.

The adhesive can be applied to the finger faced surface (121) of the distal portion (160) by any means known in the art such as slot coating, spiral, or bead application or printing. Typically the adhesive is applied at a basis weight of from 0.01 $g/m^2$ to 50 $g/m^2$, preferably from 1 $g/m^2$ to 30 $g/m^2$, more preferably from 5 $g/m^2$ to 25 $g/m^2$ depending on the end use envisioned.

The attachment means (150) is preferably covered with the release film (R) to protect the attachment means (150) from contamination before use, such as siliconized paper or film. A suitable release film may be manufactured from a wide range of materials such as woven and non-woven materials; polymeric materials such as thermoplastic films, plastic films, and hydroformed thermoplastic films; forms; reticulated forms; reticulated thermoplastic films; and thermoplastic scrims.

Figure 5A:
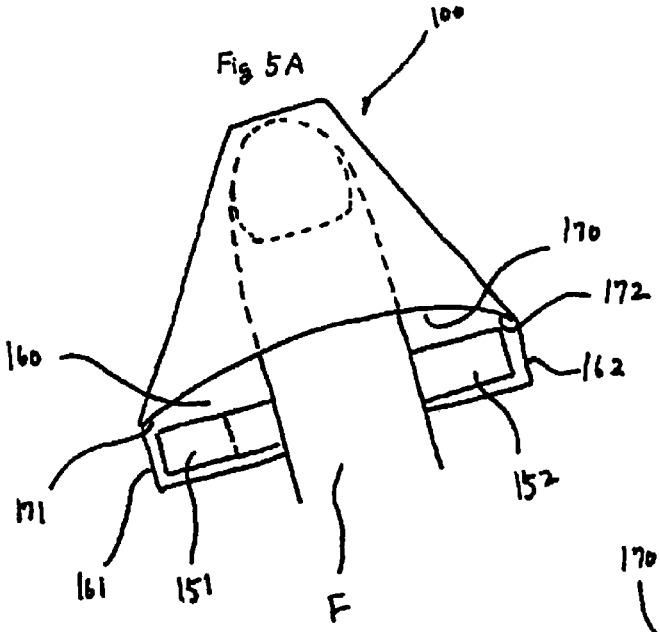
FIG. 5A is a first schematic view of the disposable tooth cleaning article of FIG. 1 when the article is worn.
Figure 5B:
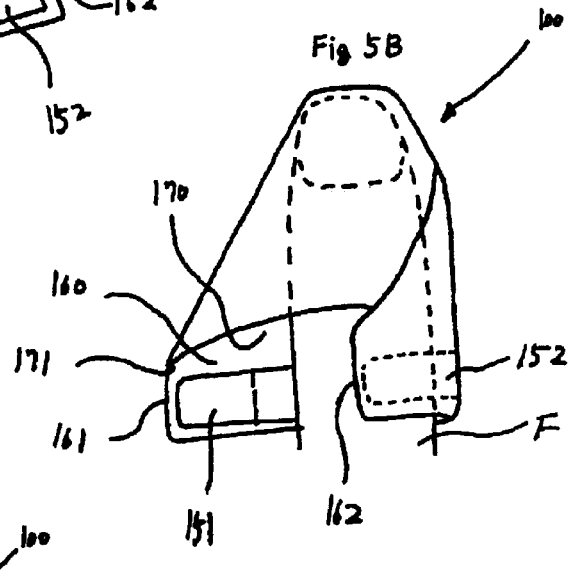
FIG. 5B is a second schematic view of the disposable tooth cleaning article of FIG. 1 when the article is worn.
Figure 5C:
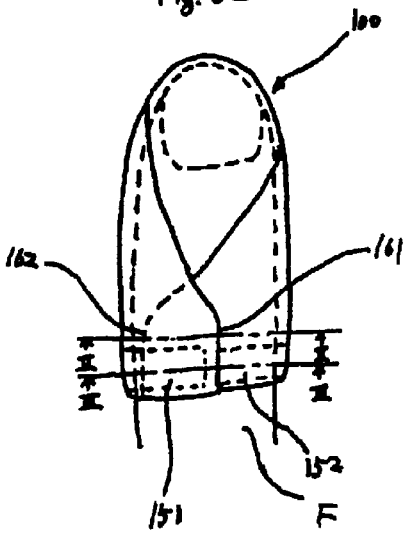
FIG. 5C is a third schematic view of the disposable tooth cleaning article of FIG. 1 when the article is worn.
Figure 5D:
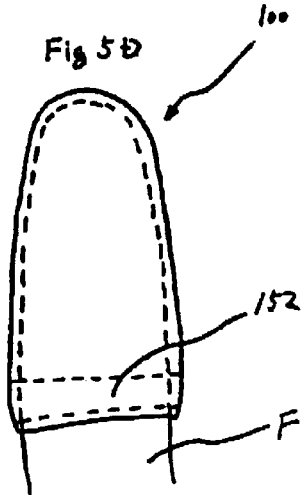
FIG. 5D is a fourth schematic view of the disposable tooth cleaning article of FIG. 1 when the article is worn.

Referring now to FIGS. 5A–5D, the wearer's finger (F) is inserted into the opening (170) of the article (100) as shown in FIG. 5A. Then, the edge (162) of the distal portion (160) is wound about the wearer's finger (F), and then the edge (161) of the distal portion (160) is wound about the wearer's finger (F) such that the edge (161) and the edge (162) overlap one another as shown in FIGS. 5B and 5C. The finger faced portion (121) of the edge (161) and the outer surface (122) of the edge (162) of the distal portion (160) are adhered to one another by the first attachment means (151) of the attachment means (150) to maintain the wound configuration of the distal portion (160) when the dorsal portion (160) is wound about the wearer's finger (F), furthermore, the second attachment means (152) of the attachment means (150) contacts to the ventral side of the wearer's finger (F) to attach the article (100) to the wearer's finger (F) as shown in FIGS. 5D and 6B.

The outer surface (122) of the first sheet (130) and/or the second sheet (140) may comprise flavor. The flavor which is adhered to the outer surface (122) of the second sheet (140) is encapsulated to protect it against changes in its physical and chemical properties. The encapsulating material used must be water-soluble in order to release the flavoring materials when the article (100) is in contact with the moisture in the mouth. One example of an encapsulating medium is an aqueous hydrophilic colloid which may have as its sole major component a protein-based material such as casein, soy protein, or other vegetable or animal protein or proteins which are capable of forming colloidal dispersions in water, which can be gelled either by changes in temperature or by changes in concentration, and which when dehydrated form a substantially air-impervious capsule. Alternatively, the sole or major component of the hydrophilic colloid may be a non-protein based material such as vegetable gum, e.g., gum arabic, gum, gum tragacanth, locust bean gum, and the like. These vegetable gums have the advantage of not reacting with the aldehydes contained in aromas, flavors, and the like, and, where only flavors are to be encapsulated, are preferable to a protein material as the major component of the capsule wall. Other materials which may comprise the hydrophilic colloid include cellulose and starch ethers, solubulized cellulose and starch products, carboxypolymethylenes, styrene-maleic acid reactionproducts, polyvinyl alcohols, polysaccharide B-1459, and dextran.

The stability of the encapsulated flavor can be further increased by incorporating into the flavor constituents an antioxidant before the flavor is emulsified in the colloid solution prior to encapsulation. The effective and useful antioxidants are butylated hydroxytoluene and butylated hydroxyanisole, used either by themselves or in combination with each other or with other antioxidants, such as propylgallate. The quantity of the antioxidants incorporated into the capsules depends on the stability requirements of the products in use and is limited only by their effect on the flavor of the final product.

The preferred flavoring materials for use in the article (100) are those that will leave a fresh, clean taste in the mouth after use of the article (100), such as peppermint, spearmint, wintergreen, cloves; or anise. Other flavorings that may be used include fruit flavors such as cherry, lemon, lime, orange, etc.

Other materials that may be adhered to the outer surface (122) of the first sheet (130) and/or the second sheet (140) to aid in treating the teeth include bacteriostats, soap or detergents, dentifrices, and the like. Where a more positive abrasive action is desired, polishing agents which also aid in treating the teeth such as kaolin, precipitated chalk, fine pumice, iris root powder, and the like may be adhered to the first sheet (130) and/or the second sheet (140) the article (100).

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A disposable tooth cleaning article for manually cleaning toot surfaces and for stimulating gums, the disposable tooth cleaning article extending in a longitudinal direction and a transverse direction, the disposable tooth cleaning article having a wearer's finger faced surface and an outer surface, the disposable tooth cleaning article comprising a first sheet and a second sheet, the first sheet and the second sheet forming a pouch extending in the longitudinal direction and having an opening wherein, the disposable tooth cleaning article has a distal portion extending opposite to the pouch beyond the opening, the distal portion is wound about a wearer's finger when the disposable tooth cleaning article is used, the finger faced surface is provided with a first attachment means, a distinct second attachment means and a distinct third attachment means, the first attachment means is located on the finger faced surface of the distal portion adjacent to a first transverse edge of the opening to maintain the wound configuration of the distal portion, the second attachment means is located on the finger faced surface of the disposable tooth cleaning article to contact to the wearer's finger when the distal portion is wound about the wearer's finger, the third attachment means is located on the finger faced surface of the distal portion at the center in the transverse direction.

2. The disposable tooth cleaning article of claim 1 wherein the opening has a width such that both edges of the opening overlap to one another when the distal portion is wound about the wearer's finger when the disposable tooth cleaning article is used.

3. The disposable tooth cleaning article of claim 2 wherein the width of the opening is not less than 20 mm.

4. The disposable tooth cleaning article of claim 2 wherein the distal portion has a width being equal to or longer than the width of the opening and both edges of the distal portion overlap to one another when to distal portion is wound about the wearer's finger when the disposable tooth cleaning article is used.

5. The disposable toot cleaning article of claim 4 wherein the second attachment means is located on the finger faced surface of the distal portion adjacent to a second transverse edge of the opening opposite to the transverse edge adjacent to the first attachment means.

6. The disposable tooth cleaning article of claim 1 wherein the first sheet contacts to a dorsal side of the wearer's finger and the second sheet contacts to a ventral side of the wearer's finger wherein the distal portion is formed by an extension of the second sheet.

7. The disposable tooth cleaning article of claim 6 wherein the second sheet is liquid impermeable.

8. The disposable tooth cleaning article of claim 7 wherein the second sheet comprises at least two layers wherein the innermost layer of the at least two layers is liquid impermeable.

* * * * *

UNITED STATES PATENT AND TRADEMARK OFFICE

CERTIFICATE OF CORRECTION

PATENT NO. : 6,898,819 B2
DATED : May 31, 2005
INVENTOR(S) : Yuko Tanaka et al.

It is certified that error appears in the above-identified patent and that said Letters Patent is hereby corrected as shown below:

Column 7,
Line 6, delete “fingernnn” and insert therefor -- finger --.

Column 12,
Line 53, delete “toot” and insert therefor -- tooth --.

Column 14,
Line 1, delete “to distal portion” and insert therefor -- the distal portion --.
Line 4, delete “toot” and insert therefor -- tooth --.

Signed and Sealed this

Sixteenth Day of August, 2005

JON W. DUDAS
*Director of the United States Patent and Trademark Office*